United States Patent [19]

Brockhaus

[11] Patent Number: 4,549,323

[45] Date of Patent: Oct. 29, 1985

[54] WATERBED MATTRESS PAD

[76] Inventor: Peter B. Brockhaus, Rte. 1, Owen, Wis.

[21] Appl. No.: 527,013

[22] Filed: Aug. 29, 1983

[51] Int. Cl.[4] ..... A47C 27/08; B32B 3/02

[52] U.S. Cl. ..... 5/455; 5/449; 5/450; 5/451; 428/72; 428/76; 428/178

[58] Field of Search ..... 5/449, 450, 451, 452, 5/453, 454, 455, 456, 457, 458; 428/178, 68, 72, 76

[56] References Cited

U.S. PATENT DOCUMENTS

| | | | |
|---|---|---|---|
| 3,577,305 | 5/1971 | Hines et al. | 428/72 |
| 3,640,831 | 2/1972 | Gardner et al. | 428/72 |
| 4,038,447 | 7/1977 | Brock | 428/178 |
| 4,145,780 | 3/1979 | Fogel | 5/451 |
| 4,167,598 | 9/1979 | Logan et al. | 428/178 |
| 4,266,307 | 5/1981 | Critelli | 5/451 |
| 4,292,701 | 10/1981 | Woychick | 5/451 |
| 4,356,642 | 11/1982 | Herman | 428/178 |

FOREIGN PATENT DOCUMENTS

| | | | |
|---|---|---|---|
| 1029870 | 5/1966 | United Kingdom | 428/72 |

*Primary Examiner*—William J. Van Balen
*Attorney, Agent, or Firm*—Fuller, House & Hohenfeldt

[57] ABSTRACT

An insulated mattress pad eliminates the necessity of heating the water of a waterbed by electrical or other means. The mattress pad includes a pocketed covering of washable materials into which is removably inserted an insulating pad formed of an insulating laminate. The laminate comprises at least one layer of insulating air bubbles sandwiched between heat reflecting skins and abrasion resistant outer sheets. The mechanical stiffness of the mattress pad allows the use of thinner backing pads, such as foam, while maintaining the comfortable feel of thick backing pads.

4 Claims, 4 Drawing Figures

WATERBED MATTRESS PAD

BACKGROUND OF THE INVENTION

1. Field of the Invention

This invention pertains to insulating materials, and more particularly to insulating materials that increase the comfort of sleeping persons.

2. Description of the Prior Art

It is well known that the body heat of a sleeping person is readily transferred to the water of a water mattress if the water is not kept at a fairly high temperature. Especially in older people, the danger of hypothermia is acute. Since the body temperature usually remains about 98°-99°, it is necessary that the water temperature be about 80°-85°, depending upon the comfort range of the individual person. If the room ambient temperature is normally 70°-75°, the water must be heated, usually by an electrical heater under thermostatic control, to the desired temperature. Because of the mass of the water, its temperature cannot be changed quickly. Thus, the heater is usually left on during daytime hours as well as at night. The resulting usage of electrical energy is costly. The control and heater have limited useful lives, thus requiring the eventual expense of replacement. Moreover, the inherent physical comfort of a waterbed can be counterbalanced by the anxiety of some people over sleeping on an electrical appliance. Similar anxieties are frequently present regarding electric blankets.

To eliminate the problems encountered with electrically heated bedding material, attention has turned to providing coverings and mattress pads with increased insulation properties. For example, U.S. Pat. No. 2,596,547 illustrates a bed cover containing a number of relatively small sewn pockets into which can be inserted formed pads of insulating material such as wool, kapok, or down. The insulating pads can be removed when required for laundering the bed cover. It will be apparent that the sewn construction of the pockets of the 2,596,547 patent is expensive. Further, it is a laborious and time consuming chore to remove and insert the numerous small pads of insulating material into the pockets. Other designs of pocketed bedding material, although not necessarily for insulating purposes, are shown in U.S. Pat. Nos. 2,576,455, and 2,614,273.

Another heat related development in bedding materials is the utilization of the heat reflecting properties of metal foil. In the past, the primary function of the foil has been to decrease the danger to people who smoke in bed, i.e., the concern has been with creating fireproof mattress covers and pads, as exemplified by U.S. Pat. Nos. 2,801,427 and 3,818,520. While the metal foil serves admirably in reflecting heat, the previous mattress pads incorporate the foil as a permanent part of the pad, thus precluding washing or altering the pad.

When a person moves on the surface of a waterbed, the water within flows from a high pressure region to a low pressure region. This produces the so-called 'wave effect', and a second person on the bed may be bounced until the water pressure is equalized. Closely related to the wave effect is the "sinking effect", which is concerned with the amount a person will sink into the water mattress. Since ordinary mattress pads and sheets are quite flexible, they offer little or no assistance in preventing the sinking effect. Some waterbeds are equipped with internal baffles to damp the wave effect. Over filling the mattress or adding thickening agents to the water have been attempted. However, internal baffles are expensive, and water thickening agents make draining the waterbed difficult.

Thus a need exists for an insulated mattress pad that is low in cost, easy to use and launder, and that provides more comfortable sleeping in a waterbed than was previously possible.

SUMMARY OF THE INVENTION

In accordance with the present invention, an insulated mattress pad is provided that reduces the transfer of body heat from a sleeping person to the mattress in an economical, comfortable, and convenient manner. This is accomplished by the arrangement of materials to include a pocket-type covering and a removable insulating pad.

The insulating pad is preferably of laminated construction comprising three components. The first component is a double layer of encapsulated air bubbles. Each layer of bubbles may be formed by embossing a thin sheet of synthetic material such as polyethylene with numerous closely spaced indentations. The side of the embossed sheet containing the open sides of the indentations is bonded to the second component of the laminate, which is a flat skin of thin flexible material. Thus, air in the indentations of the first material is encapsulated into a flat layer of insulating bubbles. Preferably, the crowns of two layers of bubbles are bonded together to form a laminate of two layers of bubbles, with the flat skins to the outside. The skins may be composed of numerous materials. A preferred material is highly reflective foil. The third component of the laminate, a second layer of thin flexible material, is bonded to the outside of each of the thin skins. The function of the outer skins is to reduce abrasion of the insulating bubbles and thin skins under continued usage in the mattress. The preferred material for the outermost layers of the laminate is polyethylene.

The present invention is also concerned with the stiffness of the insulating mattress pad. The laminate tends to act as a beam; consequently it resists bending. The bending resistance, or stiffness, tends to both damp the oscillations of a waterbed produced by a moving sleeper and to keep the sleeping person from sinking too deeply into the water mattress.

It is a feature of the present invention that the insulating and stiffness properties can be easily altered. This is accomplished by inserting more than one insulating pad into the covering pocket.

The covering may be constructed of well-known and readily available bedding materials. Preferably, at least one side of the covering is moisture absorbing. The covering may be readily laundered merely by removing the insulating pad from the covering pocket.

In keeping with the present invention, the insulating pad may be used in conjunction with a foam backing pad, which is used by some people to enhance the comfort of a waterbed. The stiffness of the insulating pad allows thin foam pads to be used without detrimental effects to the feel of the waterbed. In a modified mattress pad, a zipper may be employed to encase the insulating pad and foam backing pad between the mattress and the top cover.

Other objects and advantages of the invention will become apparent from the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
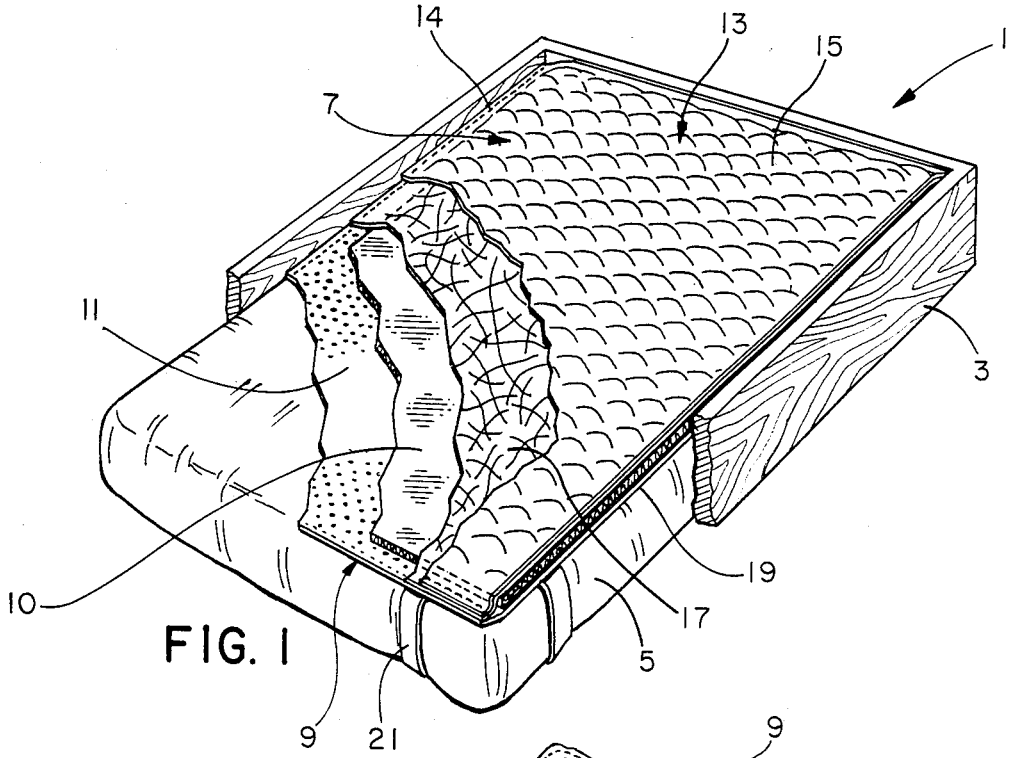
FIG. 1 is a partially broken perspective view of a waterbed incorporating the mattress pad of the present invention.

Referring to FIG. 1, a bed 1 is illustrated that includes the insulated mattress pad of the present invention. The mattress pad finds particular usefulness in conjunction with waterbeds, but it will be understood that the invention is not limited to waterbed applications.

The bed 1 includes a frame 3 which supports and positions a water mattress 5. The water mattress may be encased in a conventional mattress liner, not shown, to contain the water if the mattress leaks. The frame may be padded or covered with decorative material, as is well known in the art.

Figure 2:
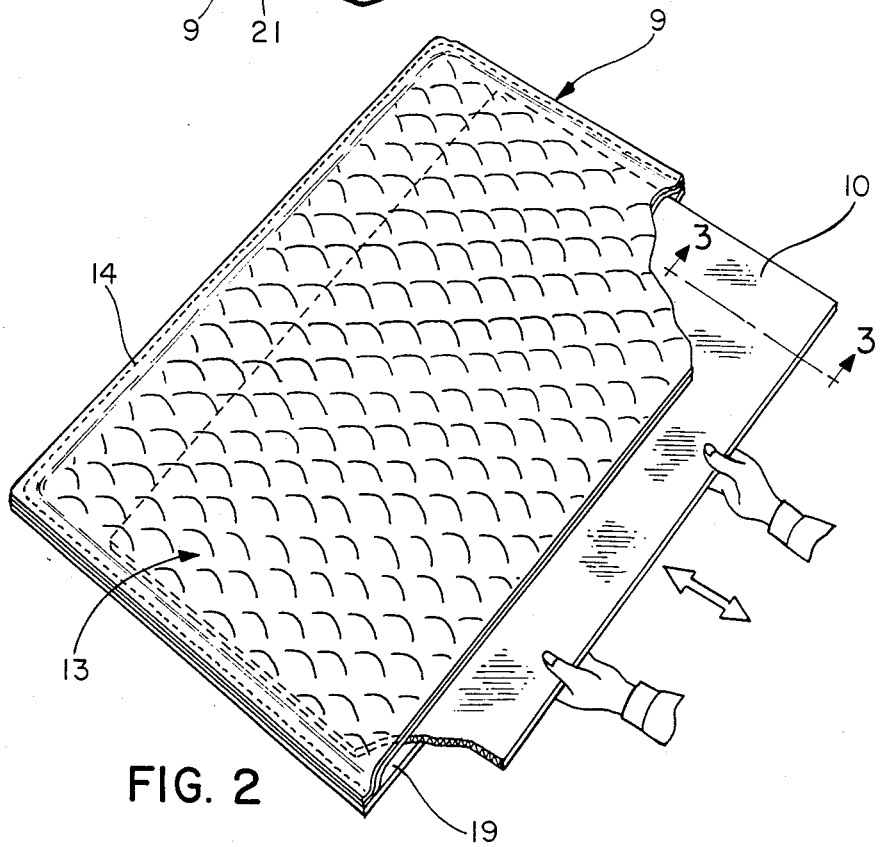
FIG. 2 is a partially broken perspective view of the mattress pad showing the insertion and removal of the insulating pad from the covering.

In accordance with the present invention, an insulated mattress pad 7 is provided that eliminates the necessity of heating by electricity or otherwise the water in the waterbed to a comfortable temperature. In the illustrated embodiment, the mattress pad includes a pocketed covering 9 and an insulating pad 10, FIGS. 1 and 2. The covering 9 is constructed from conventional materials. Preferably, the bottom cover 11 is of a moisture and stain resistant but air permeable non-woven synthetic material such as manufactured by Kimberly-Clark Corporation under the trademark "Evolution". The top cover 13 is preferably composed of an outer layer 15 of "Evolution" material quilted to an inner layer 17 of dacron fiberfill material. If desired, the dacron material may be decorative. The use of breathable but moisture resistant material is very important. The water mattress is impervious to moisure, and sleeping persons frequently perspire. Consequently, dampness is experienced in most waterbeds. The moisture problem is often solved by using several layers of blankets or sheets to absorb the moisture and keep the sleeping person dry. However, a better solution is to employ a non-absorbent top fabric in combination with an absorbent material, as that will keep the sleeping person dryer than with woven fabrics while still permitting the absorption of moisture.

To allow easy insertion and removal of the insulated pad 10, the top cover 13 and bottom cover 11 are joined, as by stitchings 14, along three sides, and the fourth side 19 is not sewn. Thus, the covering 9 is formed with a pocket for receiving the insulated pad. The corners of the covering may be provided with corner straps 21.

Figure 3:
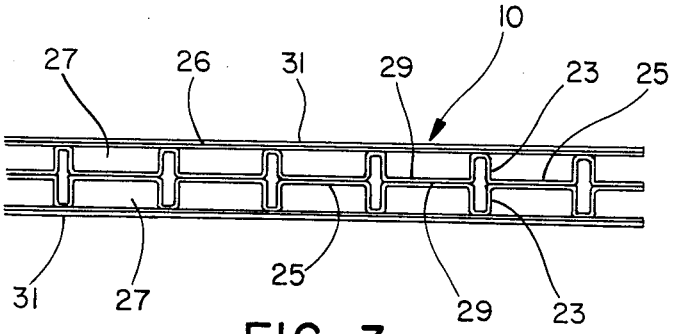
FIG. 3 is an enlarged sectional view taken along lines 3—3 of FIG. 2.

Further in accordance with the present invention, the insulated pad 10 is constructed as a moisture impervious heat reflective laminate. In the preferred embodiment, the laminate comprises three components, as best shown in FIG. 3. The first component is a thin sheet 23 of flexible material, such as polyethylene, that is embossed with numerous indentations 25. The side of the sheet containing the open sides of the indentations is bonded to the second component of the laminate, which is a skin 26 of thin flexible material. The skin is preferably made of a reflective material such as metal foil or a metal coated synthetic material. Thus, the air in the indentations is encapsulated into numerous small air bubbles 27. The crowns 29 of two layers of encapsulated air bubbles are bonded together to create a laminate of two layers of bubbles sandwiched between two outer skins 26. The laminate described is similar in construction to that described in my copending patent application Ser. No. 490,466, filed May 2, 1983.

To prevent the skin 26 from abrading and possibily coming loose from the thin sheet 23 as the insulated pad is slept on over a long period, an outer sheet 31 of thin flexible material is bonded to the outside of the skins 26. The preferred material for the outer sheet 31 is polyethylene. Thus, the outer sheet comprises the third component of the laminate.

Numerous modifications of the basic insulation laminate are possible. For example, the laminate may comprise three layers of encapsulated air bubbles interposed between two outer skins. A second modification may be a single layer of encapsulated air bubbles with a skin on both sides. In some applications a single layer of bubbles and a single skin may be advantageous. The material for each of the laminate components may also vary. For example, the bubbled sheet may be of reflecting material, and the outer skins may be of clear material. A particularly desirable laminate consists of a center sheet of reflective foil with a layer of bubbles and a skin on both sides. This combination provides two layers of dead air space on both sides of the reflective foil sheet. This configuration greatly reduces radiant heat transfer and provides a stiffness and pliability which have qualities especially desirable in a waterbed mattress pad. In each modification, the outermost component on both sides of the laminate is an abrasion resistant sheet of thin flexible material, preferably polyethylene.

The insulating pad of the present invention has superior insulating qualities. The trapped air within the bubbles 27 prevent convection within the pad. The air bubbles also provide high resistance to heat conduction from the sleeping person to the waterbed. The reflective skins 26 reflect heat back to the sleeping person and cold back to the mattress. Thus, a person can sleep comfortably on a relatively cool water mattress without danger of the water draining away his body heat.

In the embodiment of the insulating pad illustrated in FIG. 3, as well as in other embodiments employing at least two skins with one or more layers of air bubbles interposed therebetween, the laminate possesses considerable resistance to bending. The outer skins act as the flanges of a beam, with the layers of bubbles acting as the web. The resistance to bending, or stifness, distributes the weight of a sleeping person over a greater area of the waterbed. As a result, the oscillations due to pressure differentials produced by a moving sleeper are damped without the use of expensive internal baffles, and an ordinary waterbed has the feel of a more expensive model. The improved weight distribution produced by the relatively stiff insulating pad has the further advantage of reducing the sinking effect commonly found in waterbeds. Because the sleeper's weight is distributed over a wider area, the person will be supported at a higher level on an ordinary waterbed without undesirable alterations to the water.

The mattress pad 7 of the present invention also provides for altering the insulating and stiffness properties in a simple manner. The stiffness can be increased merely by inserting one or more additional insulating pads 10 into the open side 19 of covering 9. The additional pads will further diminish the wave and sinking effects. The use of two or more pads will also increase the insulation properties of the mattress pad.

The comfort characteristics of the mattress pad may also be altered by turning the mattress pad upside down. For instance, in the summer it may be beneficial to have the top cover 13 between the insulating pad 10 and the sleeping person. In that condition, the inner layer 17 of absorbent quilted material is between the sleeper and the reflective foil. The body heat is not readily reflected from the insulating pad back to the sleeper and perspiration is readily absorbed, thus making sleeping on warm nights more comfortable. On the other hand, in winter it may be advantageous to turn the mattress pad so that the top cover 13 is between the waterbed and the insulating pad to insulate the cold water mattress from the sleeper. Further, the thin bottom cover 11 will allow more body heat to be reflected back to the sleeping person, thus providing more comfort on cold winter nights.

Figure 4:
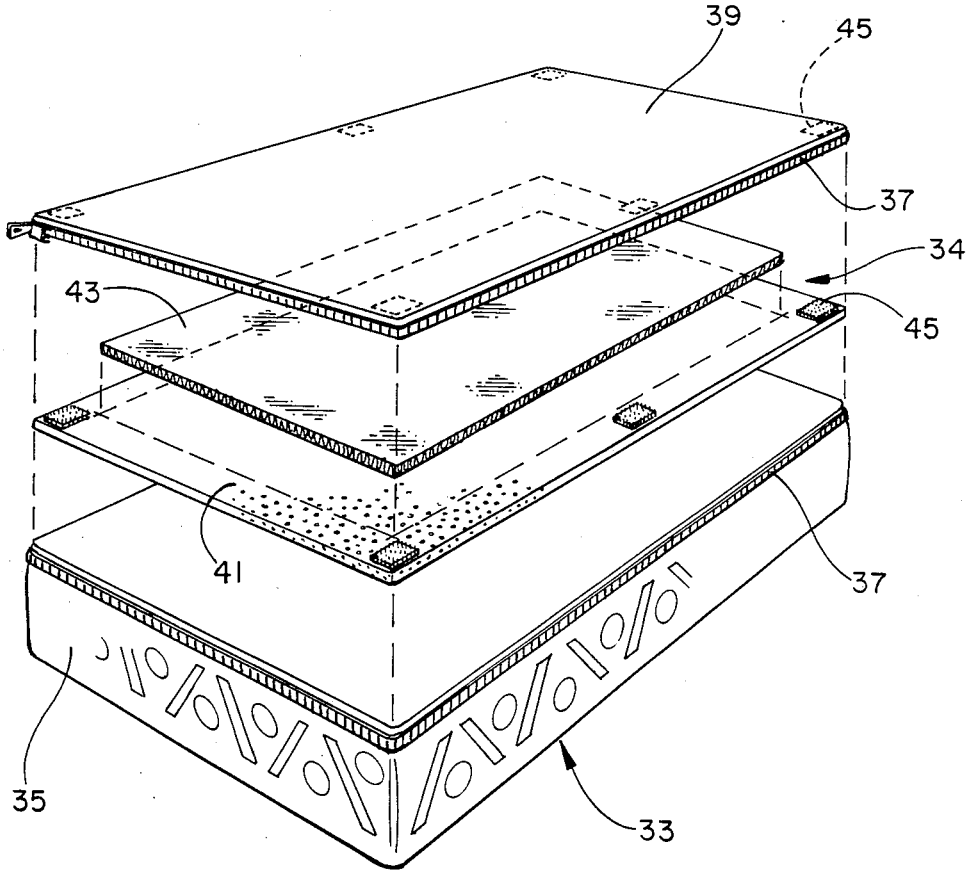
FIG. 4 is an exploded perspective view of a modification of the mattress pad.

The versatility of the mattress pad of the present invention is illustrated in FIG. 4. Reference numeral 33 indicates a water mattress and a modified mattress pad 34. The water mattress is covered on the four vertical sides with a decorative band 35. To removably fasten a top covering 39 to the mattress band, a zipper 37 is sewn or otherwise attached to the top edges of the fabric band 35 and to the edges of the top covering 39. Interposed between the top covering and the water mattress is a foam backing pad 41 which is used by some persons to provide a different feel to the waterbed and to reduce the wave and sinking effects. Typically, the backing pads are about 1½ inches thick. However, the introduction of insulating pad 43 between the backing pad and top cover permits the thickness of the backing pad to be reduced to only about ¼ inch to ½ inch while still providing the same feel to the person. To prevent the backing pads 41 from shifting about inside the mattress assembly, Velcro or other adhesive strips 45 are attached to the topside of the backing pad and to corresponding locations on the underside of the top covering 39.

Thus, it is apparent that there has been provided, in accordance with the invention, a waterbed mattress pad that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A laminated insulating pad comprising:

a. at least two layers of encapsulated air bubbles, each layer of air bubbles comprising a discrete sheet of clear polyethylene material embossed on one side with a plurality of indentations terminating in crowns, and a skin of heat reflective material substantially coextensive with and bonded to each embossed sheet on the open sides of the indentations to encapsulate the air in the indentations, the crowns of the layers of embossed sheets being bonded together in superimposed and coterminus relationship to thereby create a pair of oppositely facing outer surfaces formed by the skins; and b. a pair of abrasion resistant outer sheets of clear polyethylene material substantially coextensive with the layers of encapsulted ir bubbles, one outer sheet being bonded to each outer surface of the bonded layers of encapsulted air bubbles to prevent abrading of the encapsulated air bubbles during continuous flexing use.

2. The laminated insulating pad of claim 1 wherein the reflective material is a metal foil.

3. An insulated mattress pad comprising:

a. a pocketed covering having substantially coextensive rectangular shaped top and bottom covers fastened together along three edges thereof to form a pocket, the top cover comprising an outer layer moisture resistant air permeable non-woven fabric and an inner layer of fiberous moisture absorbing material attached to the outer layer, the bottom cover being of a moisture resistant air permeable non-woven fabric; and b. a laminated insulating pad removably inserted in the pocket of the covering, the insulating pad comprising:

i. at least two layers of encapsulated air bubbles, each layer of air bubbles comprising a discrete sheet of clear polyethylene material embossed on one side with a plurality of indentations terminating in crowns and a skin of heat reflective material embossed substantially coextensive with and bonded to each embossed sheet on the open sides of the indentations to encapsulate the air within the indentations, the crowns of the layers of embossed material being bonded together in superimposed and coterminus relationship to thereby create a pair of oppositely facing outer surfaces formed by the skins; and ii. a pair of abrasion resistant outer sheets of clear polyethylene material substantially coextensive with the layers of encapsulated air bubbles, one outer sheet being bonded to each skin of the bonded layers of encapsulated air bubbles to prevent abrasion of the encapsulated air bubbles during continuous use by a person sleeping on the mattress pad.

4. The insulated mattress pad of claim 3 wherein the reflective material is metal foil.

* * * * *

UNITED STATES PATENT AND TRADEMARK OFFICE

CERTIFICATE OF CORRECTION

PATENT NO. : 4,549,323

DATED : October 29, 1985

INVENTOR(S) : Peter B. Brockhaus

It is certified that error appears in the above-identified patent and that said Letters Patent are hereby corrected as shown below:

Column 6, line 19, change "ir" to ---air---.

Column 6, line 44, after "material" delete "embossed".

Signed and Sealed this

*Eighth* Day of *April 1986*

[SEAL]

*Attest:*

DONALD J. QUIGG

*Attesting Officer*

*Commissioner of Patents and Trademarks*